United States Patent [19]

Rathbone

[11] Patent Number: 4,976,394

[45] Date of Patent: Dec. 11, 1990

[54] TWO-PART CARTON WITH CARRYING HANDLE

[75] Inventor: Charles S. Rathbone, Waynesville, N.C.

[73] Assignee: Champion International Corporation, Stamford, Conn.

[21] Appl. No.: 507,516

[22] Filed: Apr. 11, 1990

[51] Int. Cl.[5] ..... B65D 5/46; B65D 5/32

[52] U.S. Cl. ..... 229/117.14; 229/23 BT

[58] Field of Search ..... 229/117.14, 23 R, 23 BT, 229/125.19

[56] References Cited

U.S. PATENT DOCUMENTS

| | | | |
|---|---|---|---|
| 3,554,402 | 1/1971 | Lock | 229/117.14 |
| 3,684,158 | 8/1972 | Harris | 229/117.24 |
| 4,109,849 | 8/1978 | Wood | 229/117.14 |

FOREIGN PATENT DOCUMENTS

| | | | |
|---|---|---|---|
| 112158 | 11/1968 | Denmark | 229/117.14 |
| 1915441 | 12/1969 | Fed. Rep. of Germany | 229/117.14 |
| 1288188 | 2/1962 | France | 229/23 BT |
| 6403616 | 10/1965 | Netherlands | 229/117.14 |
| 362591 | 12/1931 | United Kingdom | 229/117.14 |

*Primary Examiner*—Gary E. Elkins

*Attorney, Agent, or Firm*—Evelyn M. Sommer

[57] ABSTRACT

A carton with a handle comprises a cover member and a body member. The cover member has a plurality of panels which overlap each other to form the cover member. The body member has a plurality of panels and flaps which overlap each other to form the body member. The body member and the cover member cooperate with each other whereby when the body member is placed in the cover member the carton with a handle is formed.

7 Claims, 4 Drawing Sheets

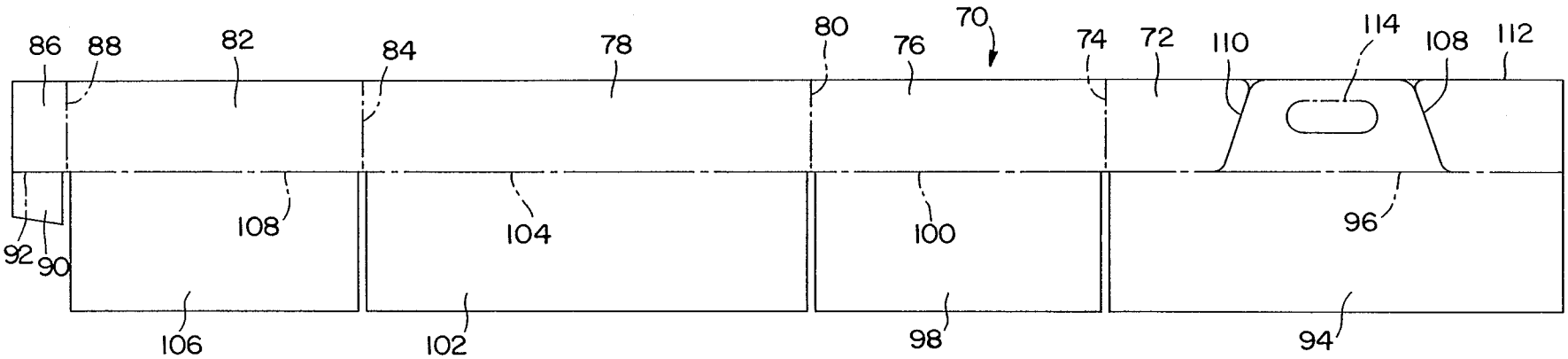
FIG. 4
FIG. 3
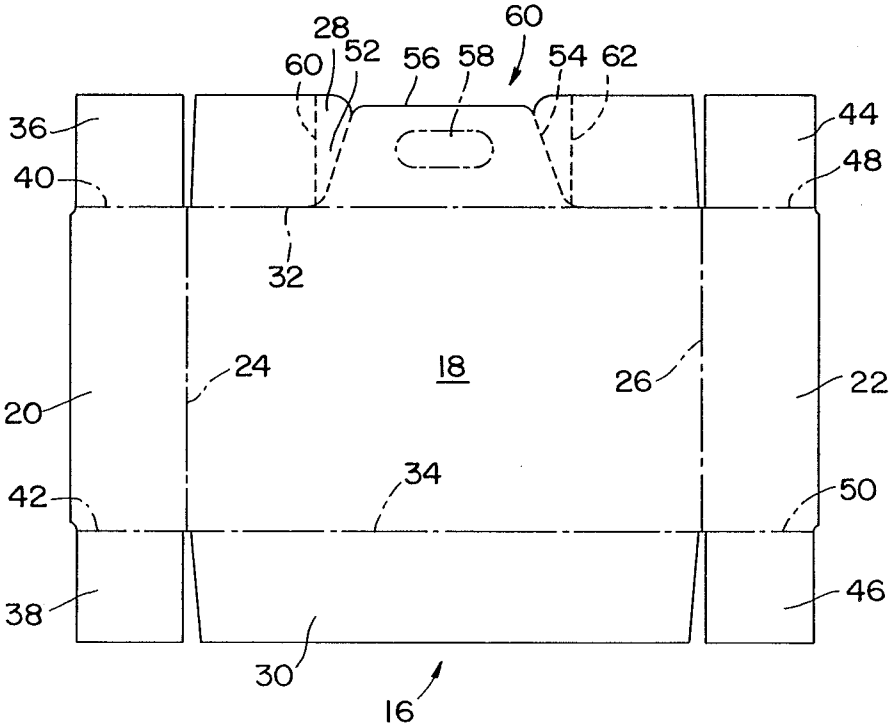

TWO-PART CARTON WITH CARRYING HANDLE

BACKGROUND OF THE INVENTION

Field of the Invention

The present invention relates to a carton formed of two sections having a handle formed on one wall. More particularly, the invention relates to a double handle arrangement located on the carton top wall which can be easily separated from the carton top wall along spaced score lines.

DESCRIPTION OF THE PRIOR AR

Cartons or containers for large quantities of consumer articles are often provided with a handle to facilitate carrying the carton with its contents. Preferably, this handle is formed from a unitary portion of a section of the carton used to form the remainder of the carton to simplify construction of the carton and to minimize expenses. For cartons containing relatively heavy articles, such as reams of paper, the carton must be sufficiently strong to withstand the considerable weight of the carton and its contents.

It is an object of the present invention to provide a carton with a handle comprising two sections which can be placed together to form a single carton.

It is a further object of the present invention to provide a carton with a handle which is sufficiently strong to carry a heavy load in addition to the container.

It is a still further advantage of the present invention to provide a carton with a handle which is relatively inexpensive to fabricate.

Accordingly, there has been provided a carton with a handle which comprises a cover member and a body member. The cover member has a first side wall panel, first and second opposed end wall panels, a first top handle panel and a first base panel. The first end wall panel includes hingedly connected first opposing top and base corner flaps. The second end wall panel includes hingedly connected second opposing top and base corner flaps. The first base panel, and the first and second base corner flaps overlap each other to form the cover member.

The body member has a second side wall panel including first and second side wall flaps, third and fourth opposed side wall panels, a second top handle panel and a second base panel. The second side wall panel includes the first side wall flap hingedly connected to the second top handle panel and the second side wall flap hingedly connected to the second base panel. The second base panel is hingedly connected to and disposed between the third and fourth opposed side wall panels. The third and fourth opposed side wall panels have third and fourth side wall flaps, respectively, hingedly connected thereto. The fourth opposed side wall panel has a tab hingedly connected to one end. The first, second, third and fourth side wall flaps, the tab and the second top handle panel overlap each other to form the body member. The body member and the cover member cooperate with each other whereby when the body member is placed in the cover member, the carton with a handle is formed.

These and other objects and advantages of the present invention will be apparent to one skilled in the art from the detailed description below taken together with the drawings.

BRIEF DESCRIPTION OF THE DRAWINGS

FIG. 3 is a plan view of the blank forming the cover member of the subject invention;

FIG. 4 is a plan view of the blank for forming the body member of the subject invention.

DETAILED DESCRIPTION OF THE PREFERRED EMBODIMENT

Figure 1:
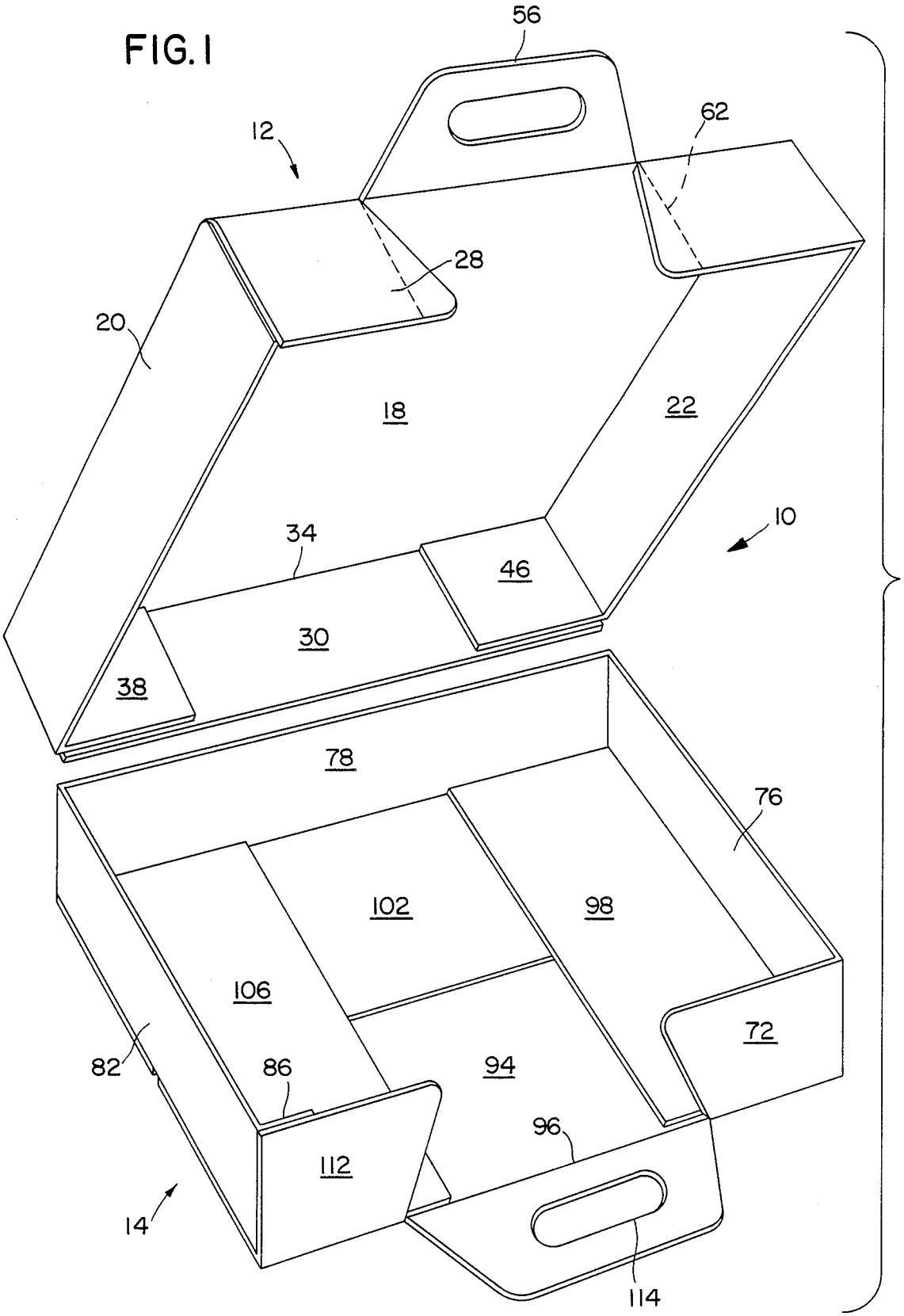
FIG. 1 is a view in perspective of the cover member and body member forming the carton with the handle according to the subject invention.

Referring to FIG. 1, the carton with a handle of the subject invention is generally designated by the numeral 10 and basically comprises a cover member 12 and a body member 14 which is received within the cover member 12. Both the cover member 12 and the body member 14 are preferably formed of a single blank of paperboard material which is die-cut and scored in order to form a unitary construction.

The first blank for forming the cover member 12 is illustrated in FIG. 3 and is generally designated by the numeral 16. The first blank 16 includes a generally rectangular, planar central first side wall panel 18 to which is hingedly connected first and second opposed end wall panels 20 and 22 along hinge lines or edges 24 and 26 of said first side wall panel 18. A first top handle panel 28 and a first base panel 30 are hingedly connected to opposed hinge lines or edges 32 and 34, respectively of said first side wall panel 18.

The first end wall panel 20 includes first opposing to and base corner flaps 36 and 38 hingedly connected to opposing hinge lines or edges 40 and 42 of the first end wall panel 20. The second end wall panel 22 includes second opposing top and base corner flaps 44 and 46 hingedly connected to opposing hinge lines or edges 48 and 50 of the second end wall panel 22.

The first top handle panel 28 is defined by first and second perforated score lines 52 and 54 which extend substantially across the entire width of the first top panel 28 from the first side wall panel 18 at hinge line 32 to an outer edge 56 of the top handle panel 28. A third enclosed score line 58 is provided in the top handle panel 28. Fourth and fifth perforated score lines 60 and 62, respectively, extend substantially across the entire width of the first top panel 28 from the first side wall panel 18 at hinge line 32 to an outer edge 56 of the top handle panel 28. The fourth perforated score line intersects the first perforated score line 52 at the hinge line 32. The fifth perforated score line intersects the second perforated score line 54 at the hinge line 32.

A second blank 70 for forming the body member 10 is illustrated in FIG. 4. The blank 70 includes a second top handle panel 72 hingedly connected at a hinge line 74 to a third side wall panel 76. A second base panel 78 is hingedly connected to the third side wall panel 76 along a hinge line 80. A fourth opposed side wall panel 82 is hingedly connected along a hinge line 84. A crush tab 86 is hingedly connected along a hinge line 88 to the opposed side wall panel 82. An end tab 90 is hingedly connected to the crush tab 86 along the hinge line 92. A first side wall flap 94 is hingedly connected along a hinge line edge 96 to the second top handle panel 72. A third side wall flap 98 is hingedly connected along hinge line 100 to the third side wall panel 76. A second side wall flap 102 is hingedly connected to the second base panel 78 along the hinge line 104. A fourth side wall flap 106 is hingedly connected along the hinge line 108 to the fourth opposed side wall panel 82.

The second top handle panel 72 is defined by sixth and seventh perforated score lines 108 and 110 which extend across the entire width of the second top handle panel 72 from the hinge line 96 to an outer edge 112 of the second top handle panel. An eighth enclosed score line is provided on the top handle panel 72 to provide a hinged hand hole.

Figure 5:
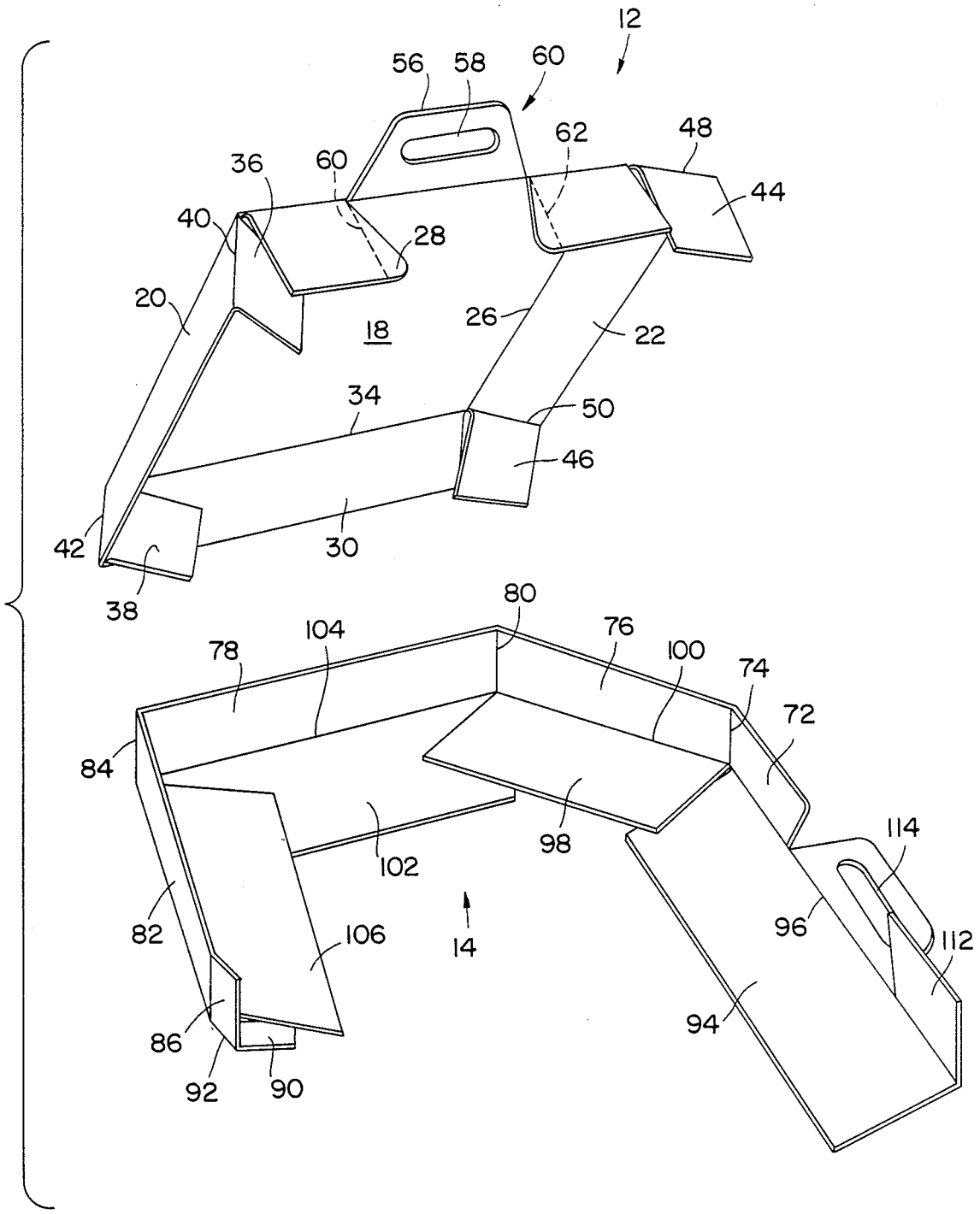
FIG. 5 is a view in perspective of the cover member and the body member in partially constructed positions.

Referring to FIGS. 1 and 5, in the erection of the cover member 12, the first and second base corner flaps 38 and 46, as well as the first and second top corner flaps 36 and 44, are folded about their hinge lines 42, 50, 40 and 48, respectively, after which first and second opposed end walls 20 and 22 are folded about their hinge lines 24 and 26, respectively. The first base panel 30 and the first top handle panel 28 are then folded about their hinge lines 34 and 32, respectively, until the first base panel 30 engages the first base corner flap 38 and the second base corner flap 46 and the first top handle panel 28 engages the first top corner flap 36 and the second top corner flap 44, respectively. In the erected position, the first and second base corner flaps 38 and 46 and the first and second top corner flaps 36 and 44 can be adhered to the first base panel and the first top handle panel by any desired means such as glue or staples. As to the assembly of the blank 70 forming the body member 14, refer to FIGS. 1 and 5. The second top handle panel 72 is folded about hinge line 74, the third sidewall panel 76 is folded about hinge line 80, the base panel 78 is folded along the hinge line 84 and the fourth opposed sidewall panel 82 is folded about the fold line 88. Next, the third sidewall flap 98 and the fourth sidewall flap 106 are folded about their fold lines 100 and 108, respectively. Then, the end tab 90 is folded about its fold line 92 and positioned so that the subsequent folding of the first sidewall flap 94 about the fold line 96 positions the end tab 90 between the first sidewall flap 94 and the fourth sidewall flap 106. Also, the second sidewall flap 102 is bent about the hinge line 104 and overlaps the third and fourth sidewall flaps 98 and 106. The overlapping flaps can be affixed to each other by any conventional means such as glue or staples.

The score lines 52 and 54 on the first blank 16 as well as the score line 108 and 110 on the blank 70 can be cut prior to the erection of the cover and body members 12 and 14, respectively. However, it is also within the terms of the present invention to cut the score line after erection or after assembly of the carton as shown in FIG. 2.

In the assembled condition of the container 10, the cover member 12 is placed over the body member 14 and pressed together so that the carton 10 is formed. The hinged hand holes can then be formed in the cover member 12 and the body member 14 by pressing partially or completely out the material within the score lines 58 and 114 of the first top handle panel 28 and the second top handle panel 72, respectively. When the two latter panels are pressed towards each other, a person can easily carry the carton by inserting their hand through the hand holes which result.

Figure 2:
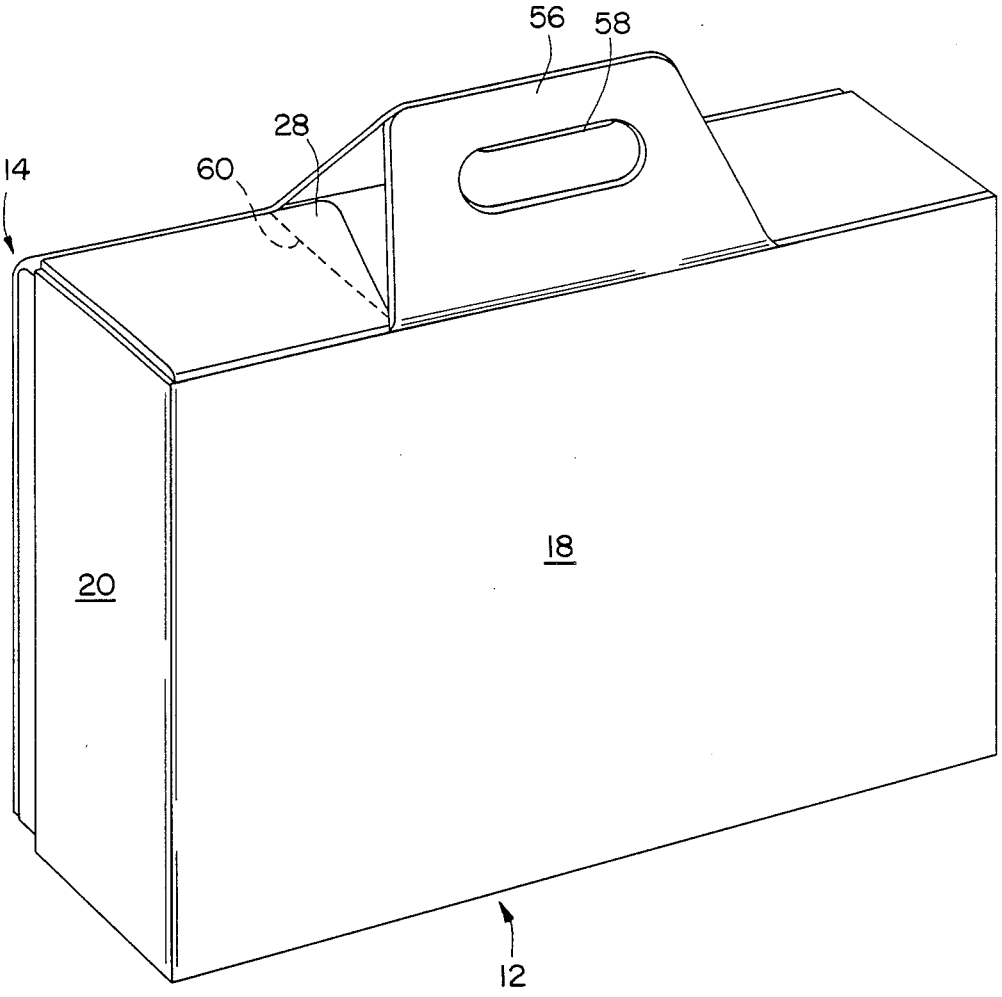
FIG. 2 is a view in perspective illustrating the cover member and the body portion of the carton in the closed position of the carton of the subject invention.

The closed container as shown in FIG. 2, can be secured by any desired means such as a strap, a rope, glue or staples.

It is apparent, that there has been provided in accordance with the present invention a container with a handle which satisfies the objects, means, and advantages set forth hereinbefore. While the invention has been described in combination with the embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A carton with a handle, comprising:

a cover member having a first side wall panel, first and second opposed end wall panels, a first top handle panel and a first base panel;

said first end wall panel including hingedly connected first opposing top and base corner flaps; said second end wall panel including hingedly connected second opposing top and base corner flaps; with said first base panel, and said first and second base corner flaps overlapping each other to form said cover member;

said first top handle panel being defined by first and second perforated score lines which extend substantially across the entire width of the first top panel from the first side wall panel to an outer edge of the top handle panel and a third enclosed score line whereby a first handle member is formed by severing said top handle panel along said two perforated score lines and at least partially severing said top panel along said third enclosed scoreline;

a body member having a second side wall panel including first and second side wall flaps, third and fourth opposed side wall panels, a second top handle panel and a second base panel;

said second side wall panel including said first side wall flap being hingedly connected to said second top handle panel and said second side wall flap being hingedly connected to said second base panel;

said second base panel being hingedly connected to and disposed between said third and fourth opposed side wall panels;

said third and fourth opposed side wall panels having third and fourth side wall flaps, respectively, hingedly connected thereto;

said fourth opposed side wall panel having a tab hingedly connected to one end;

with said first, second, third and fourth side wall flaps said tab and said second top handle panel overlapping each other to form said body member;

said second top handle panel being defined by fourth and fifth perforated score lines which extend across the entire width of the second top handle panel from the first side wall flap to an outer edge of the second top handle panel and a seventh enclosed score line whereby said second handle is formed by severing said second handle panel along said perforated score lines; and said body member and said cover member cooperating with each other whereby when said body member is placed in said cover member said carton with a handle is formed.

2. The carton of claim 1, wherein said cover member and said body member are made of paperboard material.

3. The carton of claim 1, wherein the first side wall and the second side wall are generally rectangular in plan form.

4. The carton of claim 1, further including an end tab hingedly connected to said tab, said end tab overlapping said first side wall flap and said fourth side wall flap.

5. A pair of blanks for forming a carton with a handle having a cover member and a body member comprising:

a first blank for forming said cover member, said first blank including a central, generally rectangular first side wall panel, first and second opposed end wall panels hingedly connected to opposed edges of said first side wall panel, a first top handle panel and a first base panel hingedly connected to opposed edges of said first side wall panel, said first end wall panel including hingedly connected first opposing top and base corner flaps connected to opposing edges of said first end wall panel; said second end wall panel including hingedly connected second opposing top and base corner flaps connected to opposing edges of said second end wall panel;

a second blank for forming said a body member including a second top handle panel hingedly connected to a third side wall panel, a second base panel hingedly connected between said a third side wall panel and fourth opposed side wall panel, a tab hingedly connected to said fourth opposed side wall panel, a first side wall flap hingedly connected to an edge of said second top handle panel, a third side wall flap hingedly connected to said third side wall panel, a second side wall flap hingedly connected to said second base panel, and a fourth side wall flap hingedly connected to said fourth opposed side wall panel.

6. The carton of claim 5, wherein said cover member and said body member are made of paperboard material.

7. The carton of claim 5, further including an end tab hingedly connected to an edge of said tab.

* * * * *